US011873068B2

(12) United States Patent
Parkes

(10) Patent No.: US 11,873,068 B2
(45) Date of Patent: Jan. 16, 2024

(54) LIFE PRESERVER

(71) Applicant: SURVITEC GROUP LIMITED, Birkenhead (GB)

(72) Inventor: Nigel Parkes, Salisbury (GB)

(73) Assignee: SURVITEC GROUP LIMITED, Birkenhead (GB)

( * ) Notice: Subject to any disclaimer, the term of this patent is extended or adjusted under 35 U.S.C. 154(b) by 277 days.

(21) Appl. No.: 17/309,013

(22) PCT Filed: Oct. 15, 2019

(86) PCT No.: PCT/EP2019/078010
§ 371 (c)(1),
(2) Date: Apr. 13, 2021

(87) PCT Pub. No.: WO2020/079025
PCT Pub. Date: Apr. 23, 2020

(65) Prior Publication Data

US 2022/0009606 A1 Jan. 13, 2022

(30) Foreign Application Priority Data

Oct. 16, 2018 (GB) ..... 1816798

(51) Int. Cl.
*B63C 9/125* (2006.01)
*B63C 9/08* (2006.01)
*B63C 9/18* (2006.01)

(52) U.S. Cl.
CPC ..... *B63C 9/1255* (2013.01); *B63C 9/08* (2013.01); *B63C 9/18* (2013.01)

(58) Field of Classification Search
CPC ..... B63C 9/00; B63C 9/10; B63C 9/1255; B63C 9/18; B63C 9/08
USPC ..... 441/117, 118, 123
See application file for complete search history.

(56) References Cited

U.S. PATENT DOCUMENTS 2,550,562 A * 4/1951 Hurt ..... B63C 9/1255 441/116
4,934,973 A * 6/1990 Taylor ..... B63C 9/115 441/117
6,776,678 B2 * 8/2004 Courtney ..... B63C 9/115 441/123

(Continued)

FOREIGN PATENT DOCUMENTS

DE 2103413 A1 8/1972
GB 566097 A 12/1994

(Continued)

OTHER PUBLICATIONS

International Search Report and Written Opinion dated Jan. 27, 2020 in PCT Application No. PCT/EP2019/078010.

(Continued)

*Primary Examiner* — Lars A Olson
(74) *Attorney, Agent, or Firm* — MASCHOFF BRENNAN

(57) ABSTRACT

A life preserver includes first and second buoyancy sections 3, 4 arranged such that, in use, the first and second buoyancy sections lie on opposite sides respectively of a wearer's chest, wherein said first and second buoyancy sections include respective inner facing regions that face one another above the wearer's chest, each of the facing regions having a chin support portion 11A, 11B and being configured to abut each other in use to form a chin support.

12 Claims, 7 Drawing Sheets

(56) References Cited

U.S. PATENT DOCUMENTS

| | | | |
|---|---|---|---|
| 2002/0072287 | A1 | 6/2002 | Courtney |
| 2004/0002270 | A1 | 1/2004 | Courtney |

FOREIGN PATENT DOCUMENTS

| | | | |
|---|---|---|---|
| GB | 2480255 | A | 11/2011 |
| WO | 1993/13978 | | 7/1993 |
| WO | 2007/048606 | A2 | 5/2007 |

OTHER PUBLICATIONS

Search Report dated Apr. 10, 2019 in UK Application No. GB1816798.
1.

* cited by examiner

LIFE PRESERVER

TECHNICAL FIELD

The present invention relates to a life preserver comprising first and second buoyancy sections arranged such that, in use, the first and second buoyancy sections lie on opposite sides respectively of a wearer's chest.

BACKGROUND TO THE INVENTION

Conventional life preservers, such as lifejackets, include an inflatable main body portion for providing buoyancy for the wearer so that the wearer's head is supported above the surface of the water in order to prevent drowning. Lifejackets typically include an opening for the wearer's head and neck.

A problem with known lifejackets is that, in use, water tends to flow into a wearer's mouth which can cause drowning, especially if a wearer is unconscious. This is especially a problem with split-front twin lobe lifejackets. Such lifejackets generally have two symmetrical lobes which lie on opposite sides of a wearer's chest. A channel is defined between the lobes, up the middle of the wearer's chest. In use, water tends to flow up this channel, towards the wearer's mouth.

A further problem is that, in use, the action of water on the buoyancy section causes the buoyancy section to ride up over a wearer's head. This is especially a problem with large lifejackets.

GB2480255 discloses a lifejacket having first and second buoyancy sections arranged such that, in use, the first and second buoyancy sections lie on opposite sides respectively of a wearer's chest. When the first and second buoyancy sections are brought together in a side-by-side abutting relationship, a space is defined between the first and second buoyancy sections below a wearer's chin and the first buoyancy section is provided with a chin support which extends from the first buoyancy section into said space. The chin support may be integral with the first buoyancy section and may abut the chest of the wearer and the second buoyancy section.

WO93/13978 discloses an inflatable life jacket which is held in a horse-shoe shaped cover from which the jacket breaks free when inflated. The jacket has two legs and a rear portion. The rear portion fits behind the user's head and the legs locate to opposite sides of the user's chest. The legs are approximately of equal length but their inner edges are profiled so that one has a major section which extends across the user's chest and a minor lobe which lies adjacent the user's neck and the other leg has a major lobe which also extends across the user's chest and registers with a narrow portion of the other leg lying between the major section and inner lobe so as to interfit with said narrow portion and to underlie (at least partially) said other leg to prevent the formation of a water channel between the legs. The rear portion has extension lobes to increase buoyancy behind the head.

Embodiments of the present invention seek to provide an improved life preserver.

SUMMARY OF THE INVENTION

According to the present invention there is provided a life preserver comprising first and second buoyancy sections arranged such that, in use, the first and second buoyancy sections lie on opposite sides respectively of a wearer's chest, wherein said first and second buoyancy sections include respective inner facing regions that face one another above respective opposite sides of the wearer's chest, each of the inner facing regions having a chin support portion and being configured to abut each other substantially at the centre of the wearer's chest in use to form a chin support.

In the embodiment to be described each of said first and second buoyancy sections includes an outer region at an opposite side thereof to the inner facing region, wherein the chin support portion extends from the outer region.

In the embodiment each of chin support portions is folded across buoyancy section from which it extends. In this way, the chin support portions come to be positioned at the inner facing regions of the first and second buoyancy sections, despite extending from the outer regions of first and second buoyancy sections.

In the embodiment each of chin support portions is attached to the inner facing region of the buoyancy section from which it extends. In the embodiment, the attachment happens after the folding.

In the embodiment the inner facing region includes a connection portion for attachment to the chin support portion. This may ease the attachment of the chin support portions to the inner facing region of the buoyancy section.

In the embodiment each of the chin support portions includes a first part and a second part, the first part being folded over the second part to form respective folded chin support portions. This may form a fairly rigid protruding surface to support the chin above the water in use.

In the embodiment the abutting chin support regions are configured to tend to maintain the inner facing regions of the first and second buoyancy sections spaced apart. This may allow water to pass between the first and second buoyancy sections. The flow of water may be broken by the chin support and so tends not to enter the wearer's mouth.

In the embodiment the first and second buoyancy sections (including the chin support portions) are inflatable. This provides buoyancy in a convenient manner and allows the life preserver to be stored in a compact, deflated form.

The life preserver is conveniently formed in the embodiment by two sheets of material, forming the first and second buoyancy sections, the sheets of material being selectively joined at connection regions to define an inflatable volume.

In the embodiment at least one of the first and second buoyancy sections includes a relatively reduced depth region between an upper portion and a lower portion thereof to facilitate relative rotation between the upper portion and a lower portion. This may allow the orientation of the lower portion of the buoyancy section to change so that the instead of lying generally parallel to the front of the wearer's chest, the lower portion of the buoyancy section extends generally perpendicularly to or obliquely to the front of the wearer's chest (e.g. at an angle of 45-90 degrees to the front of the wearer's chest). The reduced depth region may be a non-inflated region of the buoyancy section. The non-inflated region may be formed by one of the connection regions. In the embodiment the upper portion is configured to support the wearer's neck or head in use.

In the embodiment the first and second buoyancy sections (including the chin support portions) are symmetrical.

In the embodiment the chin support portions are integrally formed with the first and second buoyancy sections The chin support may act to close the wearer's mouth, to prevent the wearer from swallowing any water that is channelled towards his mouth. In addition, the chin support tilts the wearer's head away from the level of the water.

A further advantage may be that a chin support is provided without requiring the first and second buoyancy sections to abut or overlap. Accordingly, even if the second buoyancy section is moved away from the first buoyancy section, for example due to the action of waves, the wearer's chin may still be supported by the chin support—by one or both chin support portions). Furthermore, it is not necessary for the first or second buoyancy sections to form a close fit with the wearer's neck, in order to provide support to the wearer's chin. Such a close fit can feel uncomfortable and restrictive. This is particularly important when considering that lifejackets must work in conjunction with large subject size ranges and when worn with immersion suits on multiple layers of clothing.

In addition, when the chin support is nested under the wearer's chin, it acts to prevent the first buoyancy section from riding up over the wearer's head.

All of the features described herein may be combined with any of the above aspects, in any combination.

BRIEF DESCRIPTION OF THE DRAWINGS

For a better understanding of the present invention an embodiment will now be described by way of example, with reference to the accompanying drawings, in which.

In the drawings like elements are generally designated with the same reference sign.

DETAILED DESCRIPTION OF EMBODIMENT OF THE INVENTION

Figure 1:
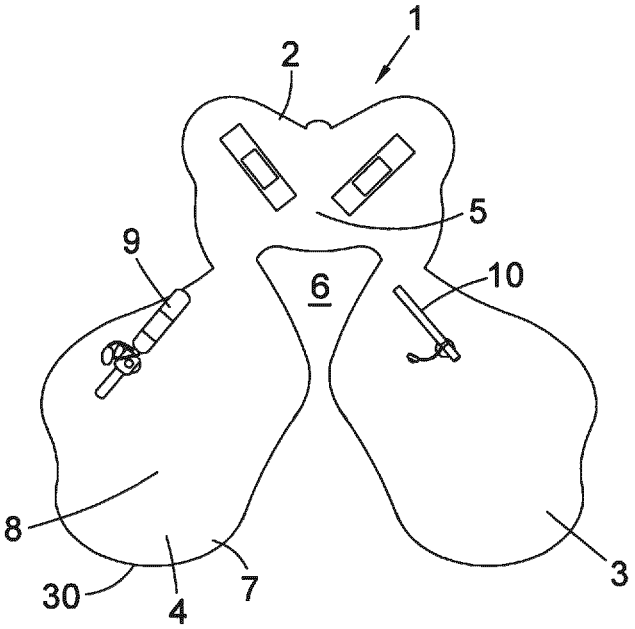
FIG. 1 shows a plan view of the front of a life preserver (that will face away from wearer's chest in use), according to the embodiment of the invention.
Figure 2:
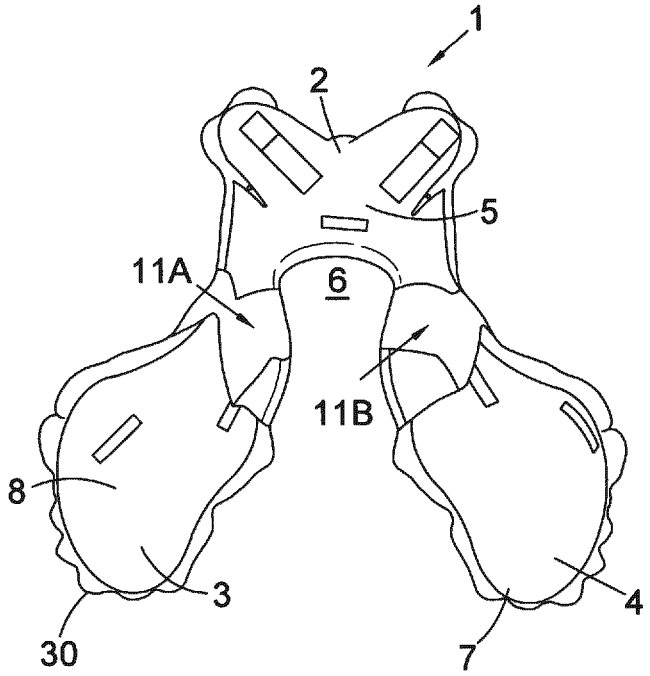
FIG. 2 shows a plan view of the rear of a life preserver (that will face the wearer's chest in use), according to the embodiment of the invention.

Referring initially to FIGS. 1 and 2, there is shown a life preserver 1, such as a lifejacket. The life preserver 1 comprises a body 2 that is generally horse-shoe shaped and is for fitting around a wearer's neck.

The body 2 comprises first and second inflatable buoyancy sections 3 and 4 which form symmetrically disposed legs of the horse-shoe, arranged to lie on opposite sides of a wearer's torso. First ends of the first and second buoyancy sections 3, 4 are joined together by a neck portion 5. The first and second buoyancy sections 3, 4 each extend from said first end to a second end, which is a free end. The first and second buoyancy sections 3, 4, together with the neck portion 5, define an aperture 6 for receiving a wearer's head and neck.

The lifejacket body 2 is formed from first and second layers of material sealed together along a seam 7 (as described below), towards a peripheral edge, to define a body inflation chamber 8. The layers of material protrude from the seam 7 to form an edge 30.

When inflated, each buoyancy section 3, 4 is an elongate member of generally oval cross section.

The inflation chamber 8 is connected to an inflation cartridge 9, containing compressed gas, that can be manually or automatically actuated. Following actuation, the inflation cartridge inflates the body inflation chamber 8.

Each buoyancy section 3, 4 is provided with a mouth-operable inflator in the form of a tube 10 connected to the interior of the body inflation chamber 8. This allows manual inflation of the body inflation chamber 8 in the event of failure of the inflation cartridge 9. Each tube 10 is provided with a non-return valve and a closure cap to prevent water flowing down the tube and into the body inflation chamber 8.

In use the first and second buoyancy sections 3, 4 lie on opposite sides respectively a wearer's chest, in side-by-side relationship.

In use, the first and second buoyancy sections 3, 4 define a space below the wearer's chin. Each of the first and second buoyancy sections 3, 4 are provided with an integral chin support 11A, 11B which extend from a portion of the first and second buoyancy sections 3, 4 provided towards the neck aperture 6.

The chin support 11A is integral with the first buoyancy section 3. The chin support 11B is integral with the second buoyancy section 4.

When the chin support is nested under the wearer's chin, it acts to prevent the first and second buoyancy sections 3, 4 from riding up over the wearer's head.

Figure 3:
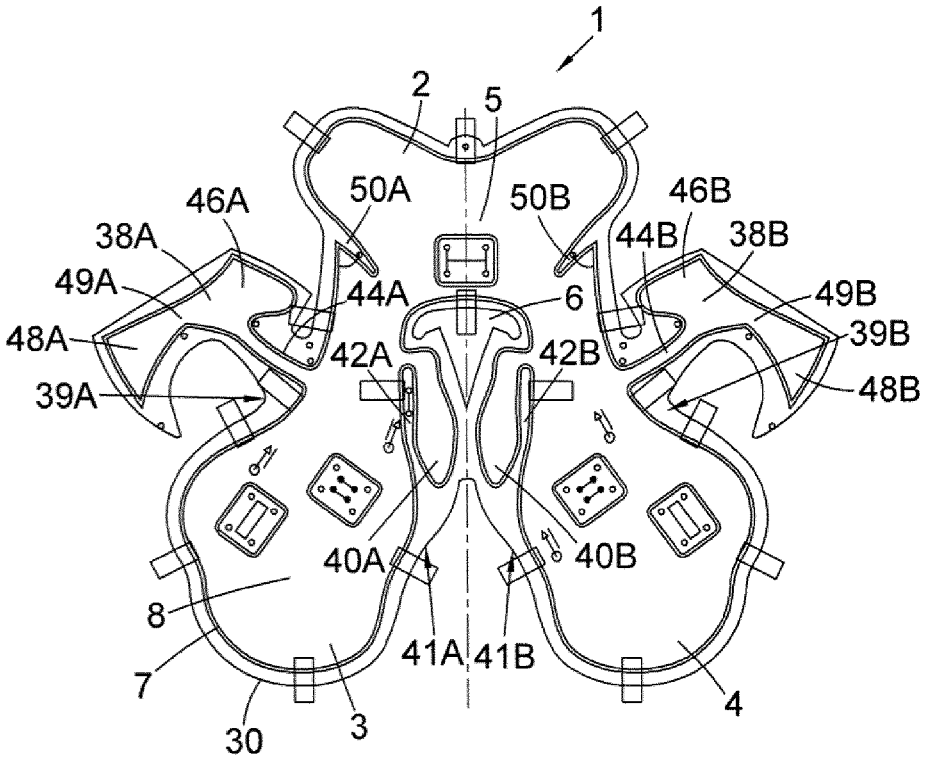
FIG. 3 shows a sheet of material used to form the life preserver.

FIG. 3 shows a plan view of a first layer of material used to form the life preserver 1. In order to form the life preserver 1, a second, substantially identical, layer is placed over the first layer and aligned with the first layer. The first and second layers of material are then heat sealed together along the seam 7. In order to achieve this heat sealing, a layer of heat melt adhesive is provided between the first and second layers of material. The first and second layers of material may be attached by any other suitable method.

The first and second layers of material are a plastic-coated fabric that is gas impermeable. It will be appreciated that any suitable material or method of heat sealing may be used.

As best shown in FIG. 3, the chin supports 11A and 11B are formed by generally T-shaped wings 38A, 38B that extend from (and are integrally formed with) an outer region 39A of the first buoyancy section 3 and an outer region 39B of the second buoyancy section 4, respectively.

An inner facing region 41A of the first buoyancy section 3 has a connection portion 40A extending therefrom (and are integrally formed therewith). An inner facing region 41B of the second buoyancy section 4 has a connection portion 40B extending therefrom (and are integrally formed therewith). In FIG. 3 the connection portions 40A and 40B are shown connected to one another. Such a connection may exist during manufacture, but is broken before use to separate the connection portions 40A and 40B from one another.

The life preserver 1 is formed by sealing said first and second layers of material together along the seam 7. The seam extends around the first and second buoyancy sections 3, 4; the wings 38A, 38B; the connection portions 40A; and the neck portion 5. A single inflatable chamber 8 is formed within the volume defined by the seam 7.

The seam 7 extends between the first buoyancy section 3 and the first connection region 40A to define defines a first non-inflated region 42A. The first non-inflated region 42A facilitates folding of the first connection region 40A with respect to the first buoyancy section 3. Similarly, the seam 7 extends between the second buoyancy section 4 and the second connection region 40B to define defines a second non-inflated region 42B. The second non-inflated region 42B facilitates folding of the second connection region 40B with respect to the second buoyancy section 4.

The generally T-shaped wing 38A comprises a stem portion 44A that connects to the outer region 39A of the first buoyancy section 3. Inflation gas passes from the first buoyancy section 3 to the generally T-shaped wing 38A in the channel between the seams 7 in the stem portion 44A. The narrowness of the stem portion 44A facilitates folding of the stem portion 44A The stem portion 44A connects to an upper head portion 46A and a lower head portion 48A of the generally T-shaped wing 38A. The lower head portion 48A includes a reduced width region 49A, where one side tapers towards the other, and which facilitates folding of the lower head portion 4SA over the upper head portion 46A.

At an upper portion of the first buoyancy section 3, at or near a junction with the neck portion 5, the seam 7 extends from the outer side inwards and downwardly towards the opening 6. This defines a reduced depth, uninflated region 50A. The uninflated region 50A facilities rotation of the first buoyancy section 3 with respect to the neck portion 5.

The life preserver 1 is symmetrical about the longitudinal axis (generally parallel to the wearer's spine). The generally T-shaped wing 38B comprises a stem portion 44B that connects to the outer region 39B of the second buoyancy section 4. Inflation gas passes from the second buoyancy section 4 to the generally T-shaped wing 38B in the channel between the seams 7 in the stem portion 44B. The narrowness of the stem portion 44B facilitates folding of the stem portion 44B. The stem portion 44B connects to an upper head portion 46B and a lower head portion 48B of the generally T-shaped wing 38B. The lower head portion includes a reduced width region 49B, where one side tapers towards the other, and which facilitates folding of the lower head portion 48B over the upper head portion 46B. At an upper portion of the second buoyancy section 4, at or near a junction with the neck portion S, the seam 7 extends from the outer side inwards and downwardly towards the opening 6. This defines a reduced depth, uninflated region SOB. The uninflated region SOB facilities rotation of the second buoyancy section 4 with respect to the neck portion S.

The uninflated regions SOA, SOB may overlie the wearer's shoulders in use (the shoulders engaging the rear side of the life preserver 1). The wearer's head/neck passes through the opening 6 and engages the front side of the life preserver 1.

Figure 4:
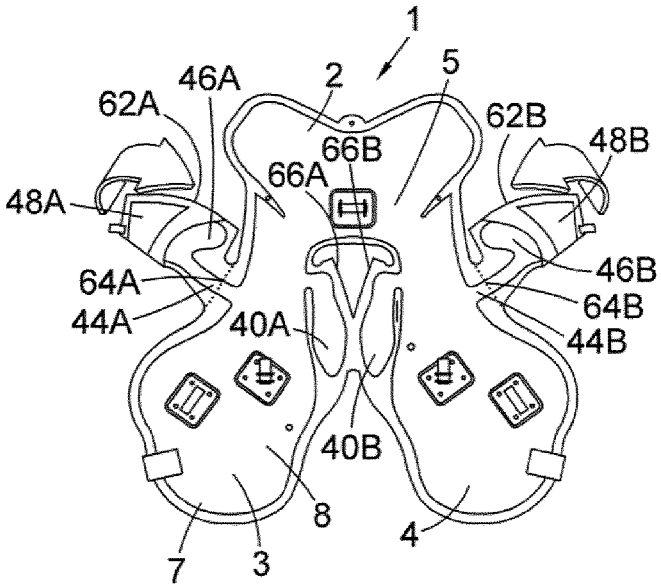
FIGS. 4 and 5 show the stages in the formation of a chin support according to the embodiment of the invention.

FIGS. 4 and S show the formation of the chin support portions 11A, 11B.

Firstly, the lower head portion 48A of the wing portion 38A is folded at reduced width region 49A so that it overlies the upper head portion 46A. The free ends of the lower head portion 48A and the upper head portion 46A are then connected at line 62A, e.g. by welding.

Similarly, the lower head portion 48B of the wing portion 38B is folded at reduced width region 49B so that it overlies the upper head portion 46B. The free ends of the lower head portion 48B and the upper head portion 46B are then connected at line 62B, e.g. by welding.

Secondly, the head (comprising the upper head portion 46A and a lower head portion 48A) of the wing portion 38A is folded along fold line 64A of the stem 44A. The lower head portion 48A then overlies the first buoyancy section 3 and the connection portion 40A. The connected lower head portion 48A and upper head portion 46A at line 62A are then connected to a distal edge 66A of the connection portion 40A, e.g. by welding.

Similarly, the head (comprising the upper head portion 46B and a lower head portion 48B) of the wing portion 38B is folded along fold line 64B the stem 44B. The lower head portion 48B then overlies the second buoyancy section 4 and the connection portion 40B. The connected lower head portion 48B and upper head portion 46B at line 62B are then connected to a distal edge 66B of the connection portion 40B, e.g. by welding.

Figure 5:
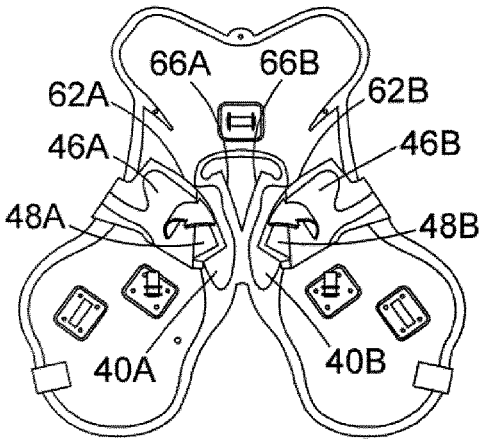
Figure 6:
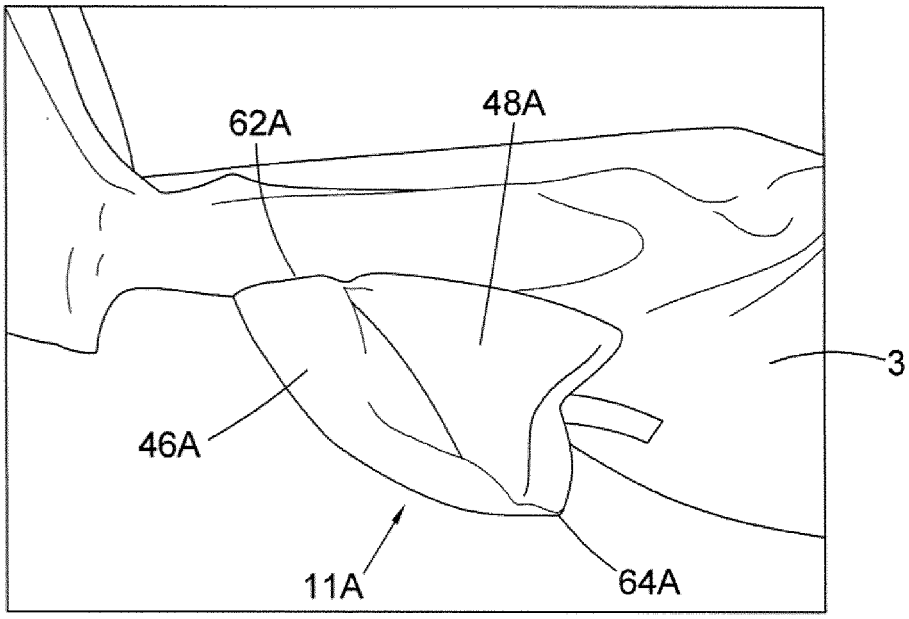
FIG. 6 shows a partial side view of the life preserver, from the outside, including the chin support according to the embodiment of the invention.
Figure 7:
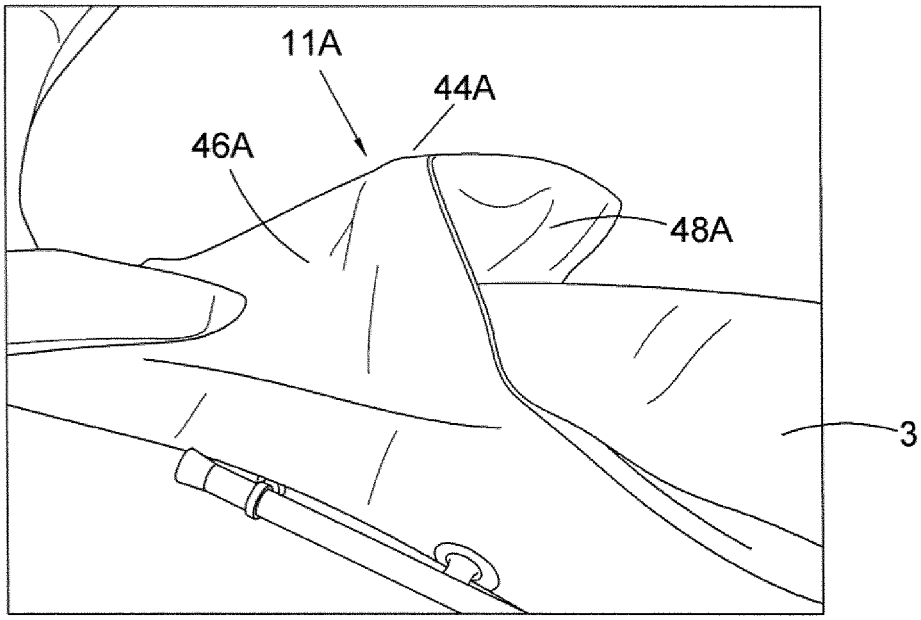
FIG. 7 shows a partial side view of the life preserver, from the inside, including the chin support according to the embodiment of the invention.

The second step, together with inflation, causes the first and second buoyancy section 3, 4 to rotate in opposite directions by approximately 45 degrees with respect to the neck portion 5, facilitated by the uninflated regions 50A, SOB. The upper faces (as shown in FIG. 5) of the lower head portions 48A and 48B become generally parallel to one another and are configured to abut in use. This brings the upper faces (as shown in FIG. 5) of the upper head portions 46A, 46B together to form a chin support will in use contact the wearer's chin.

As the chin supports 11A, 11B have a low volume and depth they are readily deformable, providing for comfort around the neck and chin. The lower head portions 48A and 48B running generally perpendicular to the chest provide vertical support to especially prevent ride up of the life preserver 1 over the wearer's head.

One or more straps may be attached to the life preserver 1 and may pass around the torso of the wearer to secure the lifejacket 1 to the wearer. Examples of suitable strap arrangements are described below in relation to FIGS. 8, 9 and 10.

As mentioned above, the first and second buoyancy section 3, 4 are generally oval in transverse cross-section, the width dimension being greater than the depth dimension. The uninflated regions SOA, SOB allow the first and second buoyancy sections 3, 4 to rotate relative to the neck portion S so that the larger dimension, instead of overlying and being generally parallel to the chest of the wearer, extends generally perpendicular to or obliquely to the chest of the wearer.

The uninflated regions SOA, SOB provide pivot hinges for the 3D shaping of the life preserver 1. The uninflated regions SOA, SOB overlie the wearer's shoulders in use. When the life preserver 1 is inflated over the shoulders, uninflated regions SOA, SOB and the larger depth neck section S can sit on the same plane i.e. the uninflated regions SOA, SOB allow a uniform bend to the life preserver 1 without the shoulder regions collapsing due to twisting (the first and second buoyancy sections 3, 4 are held at an angle of approximately 4S°-90° to the neck section S) and allow the neck section S to sit at the same height. The hinge point formed by the uninflated regions SOA, SOB allows for this twisting. The uninflated region SOA allows the right-hand side (viewed from the front) buoyancy section 3 to twist or rotate clockwise with respect to the neck section S (about an axis generally parallel with the wearer's spine). The uninflated region SOB allows the left-hand side (viewed from the front) buoyancy section 4 to twist or rotate anti-clockwise with respect to the neck section 5 (about an axis generally parallel with the wearer's spine). The uninflated regions

50A, SOB reduce the tendency for the adjacent inflated region to collapse due to the twisting or rotation.

The chin support may cause the first and second buoyancy sections 3, 4 to be spaced apart. The chin support can break the flow of water flowing between the first and second buoyancy sections 3, 4.

The chin support supports the wearer's chin at a relatively large height above the water level.

The chin support acts to close the wearer's mouth, thereby preventing the wearer from swallowing any water that is channelled towards his mouth. In addition, the chin support tilts the wearer's mouth away from the water.

In addition, when the chin support is nested under the wearer's chin, it acts to prevent the first and second buoyancy sections 3, 4 from riding up over the wearer's head.

Figure 8:
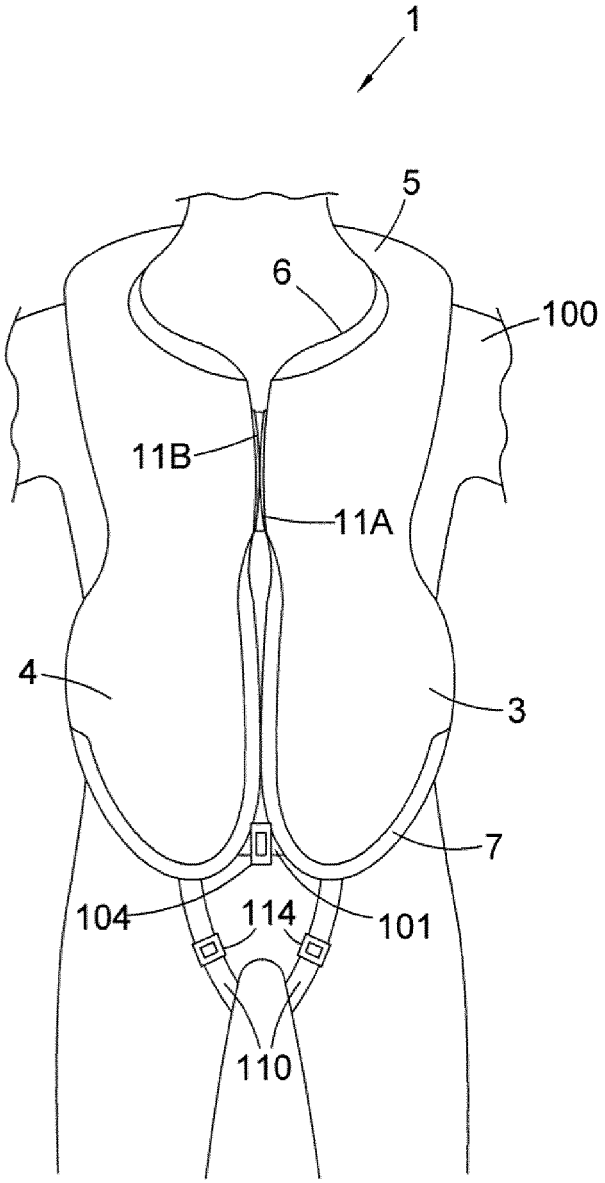
FIG. 8 shows a plan view of the front of the life preserver fitted to the torso of the wearer.
Figure 9:
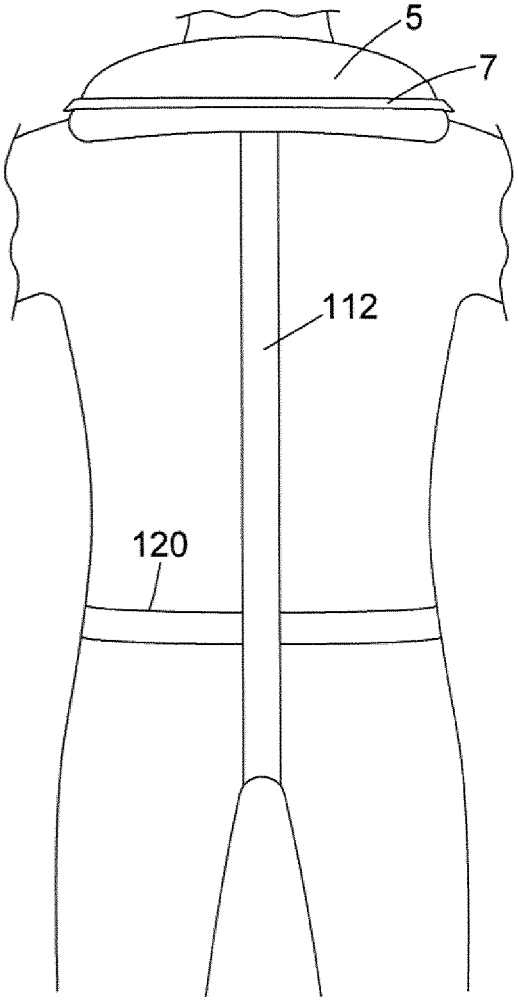
FIG. 9 shows a plan view of the rear of the life preserver fitted to the torso of the wearer.
Figure 10:
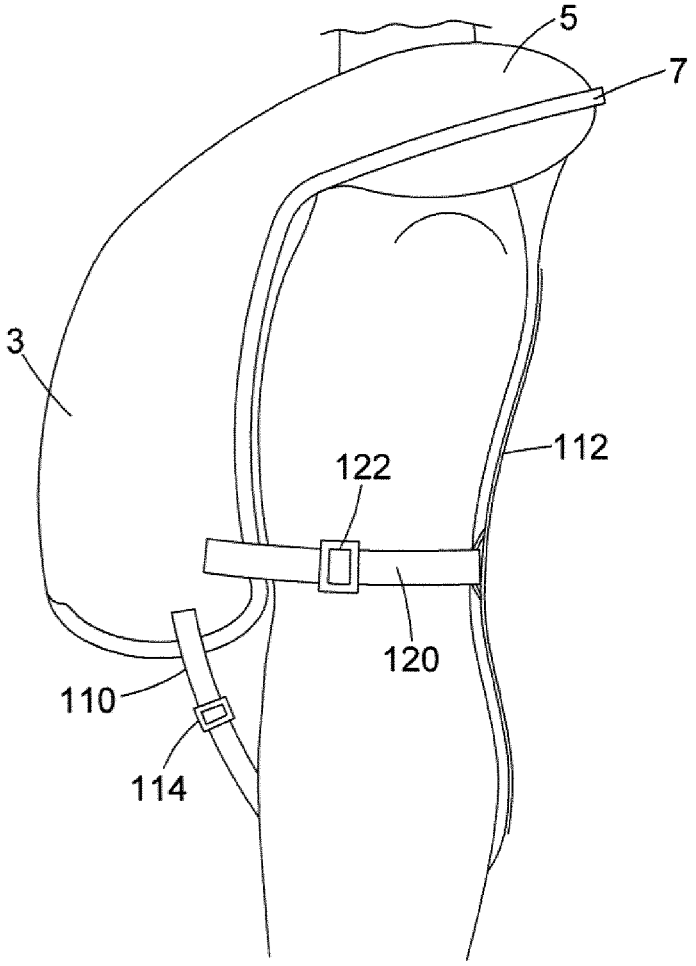
FIG. 10 shows a side view of the life preserver fitted to the torso of the wearer (the opposite side corresponds).

FIGS. 8, 9 and 10 show example arrangements for straps to attach the life preserver 1 to the wearer 100.

A front strap 102 may releasably connect together the first and second buoyancy sections 3, 4 near the distal ends thereof (near the wearer's waist, to the front thereof). A first portion of the front strap 102 is attached to the right lobe 3, a second portion of the front strap 102 is attached to the left lobe 4, and a buckle 104 releasably attaches the portions together.

Two crotch straps 110 may releasably connect the first and second buoyancy sections 3, 4 at the distal ends thereof (near the wearer's waist) to the neck portion 5 via a back strap 112 which extends along the wearer's back. The crotch straps 110 meet between the wearer's legs and connect to the back strap 112. A first one of the crotch straps 110 is attached to the right lobe 3 and a second one of the crotch straps 110 is attached to the left lobe 4. The back strap 112 is attached to the neck portion 5. The crotch straps may be opened by operating respective buckles 114.

A side strap 120 may releasably connect together the first and second buoyancy sections 3, 4 near the distal ends thereof (near the wearer's waist, to the rear thereof). A first portion of the side strap 120 is attached to the right lobe 3, a second portion of the side strap 120 is attached to the left lobe 4, and a buckle 122 releasably attaches the portions together. The side strap 120 extends around the wearer's back, near the waistline.

The above embodiments are described by way of example. Many variations are possible without departing from the invention.

What is claimed is:

1. A life preserver comprising first and second buoyancy sections arranged such that, in use, the first and second buoyancy sections lie on opposite sides respectively of a wearer's chest, wherein:

said first and second buoyancy sections include respective inner facing regions that face one another above respective opposite sides of the wearer's chest, each of the facing regions having a chin support portion connected thereto and each of the chin support portions being configured to abut each other substantially at the center of the wearer's chest in use to form a chin support;

each of said first and second buoyancy sections includes an outer region at an opposite side thereof to the inner facing region, wherein the chin support portion extends from the outer region; and each of chin support portions is folded across the buoyancy section from which it extends.

2. The life preserver of claim 1, wherein each of the chin support portions include a first part and a second part, the first part being folded over the second part.

3. The life preserver of claim 1 wherein the abutting chin support portions are configured to tend to maintain the inner facing regions of the first and second buoyancy sections spaced apart.

4. The life preserver of claim 1, wherein the first and second buoyancy sections are inflatable.

5. The life preserver of claim 4, wherein two sheets of material form the first and second buoyancy sections, the sheets of material being selectively joined at connection regions to define an inflatable volume.

6. The life preserver of claim 1, wherein at least one of the first and second buoyancy sections includes a relatively reduced depth region between an upper portion and a lower portion thereof to facilitate relative rotation between the upper portion and a lower portion.

7. The life preserver of claim 6, wherein the upper portion is configured to support the wearer's neck or head in use.

8. The life preserver of claim 6, wherein the first and second buoyancy sections are inflatable.

9. The life preserver of claim 8, wherein two sheets of material form the first and second buoyancy sections, the sheets of material being selectively joined at connection regions to define an inflatable volume, and wherein the non-inflated region is formed by one of the connection regions.

10. The life preserver of claim 1, wherein the first and second buoyancy sections are substantially symmetrical.

11. The life preserver of claim 1, wherein the chin support portions are integrally formed with the first and second buoyancy sections.

12. The life preserver of claim 1 wherein the chin support portions tend to maintain a gap between the first and second buoyancy sections.

* * * * *